US010638594B2

(12) United States Patent
Rivkin et al.

(10) Patent No.: US 10,638,594 B2
(45) Date of Patent: Apr. 28, 2020

(54) MULTI-UNDULATOR SPIRAL COMPACT LIGHT SOURCE

(71) Applicant: PAUL SCHERRER INSTITUT, Villigen PSI (CH)

(72) Inventors: Leonid Rivkin, Baden (CH); Andreas Streun, Schliengen (DE); Albin Wrulich, Baden (CH)

(73) Assignee: Paul Scherrer Institut, Villigen PSI (CH)

( * ) Notice: Subject to any disclaimer, the term of this patent is extended or adjusted under 35 U.S.C. 154(b) by 0 days.

(21) Appl. No.: 16/343,797

(22) PCT Filed: Aug. 16, 2017

(86) PCT No.: PCT/EP2017/070696
§ 371 (c)(1),
(2) Date: Apr. 22, 2019

(87) PCT Pub. No.: WO2018/072913
PCT Pub. Date: Apr. 26, 2018

(65) Prior Publication Data

US 2019/0254155 A1 Aug. 15, 2019

(30) Foreign Application Priority Data

Oct. 20, 2016 (EP) ..... 16194829

(51) Int. Cl.
*H05H 7/06* (2006.01)
*H05G 2/00* (2006.01)
(Continued)

(52) U.S. Cl.
CPC ..... *H05H 7/06* (2013.01); *H01J 3/34* (2013.01); *H05G 2/00* (2013.01); *H05H 1/00* (2013.01); *H05H 7/04* (2013.01); *H05H 13/04* (2013.01)

(58) Field of Classification Search
USPC ..... 250/492.3
See application file for complete search history.

(56) References Cited

U.S. PATENT DOCUMENTS 5,353,291 A * 10/1994 Sprangle ..... H01S 4/00 372/10
7,329,886 B2 2/2008 Siner et al.
(Continued)

FOREIGN PATENT DOCUMENTS

JP 3219376 B2 10/2001
WO 2017036840 A1 3/2017

OTHER PUBLICATIONS

Craddock M.K.—Institute of Electrical and Electronics Engineers: "The TRIUMF Kaon Factory", Proceedings of the Particle Accelerator Conference. San Francisco, May 6-9, 1991 Proceedings of the Particle Accelerator Conference, New York.
(Continued)

*Primary Examiner* — Kiet T Nguyen
(74) *Attorney, Agent, or Firm* — Laurence Greenberg; Werner Stemer; Ralph Locher

(57) ABSTRACT

A compact, small foot print, light source based on electron beam acceleration for insertion devices in EUV range metrology and actinic mask inspection using coherent scattering methods includes spiral storage rings providing plane straight sections. A magnet structure generates emittance for brilliance and coherent light content. A booster feeds the storage ring by top-up injection and keeps electron beam intensity stable. A booster level below the storage ring receives the electron beam from a linear accelerator in a central booster area. The source fits into laboratories or maintenance areas. Injection, RF-acceleration, beam manipulating devices and large diagnostics systems are required once. Higher average currents stored in the spiral enhance central cone power. Bunches are limited by ion
(Continued)

trapping and a gap clears ions. The current is increased in the spiral. Gain in central cone power increases 5 fold, assuming a gap size of half single storage ring circumference.

8 Claims, 2 Drawing Sheets

(51) Int. Cl.

| | |
|---|---|
| ***H05H 1/00*** | (2006.01) |
| ***H01J 3/34*** | (2006.01) |
| ***H05H 7/04*** | (2006.01) |
| ***H05H 13/04*** | (2006.01) |

(56) References Cited

U.S. PATENT DOCUMENTS

| | | | | |
|---|---|---|---|---|
| 7,382,861 | B2 * | 6/2008 | Madey | H05G 2/00 378/119 |
| 10,201,066 | B2 | 2/2019 | Ekinci et al. | |
| 2003/0202546 | A1 * | 10/2003 | Hartemann | G03F 7/70008 372/5 |
| 2014/0048707 | A1 | 2/2014 | Liu et al. | |
| 2014/0098919 | A1 | 4/2014 | Kumakhov | |
| 2016/0270200 | A1 | 9/2016 | Hosler et al. | |

OTHER PUBLICATIONS

Rank J. et al: "The Extraction Lambertson Septum Magnet of the SNS", Particle Accelerator Conference, 2005. PAC 2005. Proceedings of the, Piscataway, NJ, USA, IEEE /Knoxville Tennesee.

* cited by examiner

MULTI-UNDULATOR SPIRAL COMPACT LIGHT SOURCE

BACKGROUND OF THE INVENTION

Field of the Invention

The present invention relates to a compact light source based on accelerator technology with straight sections for the implementation of insertion devices. It will find its application wherever floor space is limited and the wavelength range provided by this facility is of interest. Exemplarily—but not limited to—a compact source for metrology application in the EUV range, in particular optimized for actinic mask inspection using coherent scattering methods, is presented here. A compact light source is for example proposed in the International Patent Application PCT/EP2016/069809.

A drawback of compact sources with small footprints is the limited space available for the integration of undulators or wigglers. Such a small compact source has usually a racetrack shape with two long straight sections where one is used for the implementation of an insertion device and the other one for the injection system, the accelerating cavities, beam manipulating devices as a higher harmonic cavity and large size beam diagnostics.

SUMMARY OF THE INVENTION

It is the objective of the present invention to provide a compact and cost effective light source with a small foot print based on a storage ring that can host more than one (in the present case three (but not limited to) insertion devices.

This objective is achieved according to the present invention by a spiral compact light source, where a plurality of storage rings (but not limited to) are connected in a spiral configuration that provides a corresponding number of plane straight sections for the implementation of insertion devices.

In detail, the spiral compact light source (SCL) according to the present invention based on accelerator technology with multiple straight sections for the implementation of insertion devices providing exemplarily (but not limited to) light having the characteristics for actinic mask inspection, such as at 13.5 nm, comprises the following features, wherein:

a) the required floor space is not larger than for a conventional compact source with only one undulator;

b) a plurality, i.e. three (but not limited to), of storage rings are combined in a spiral loop form;

c) the spiral loops are connected by rotation of the quarter arcs without the need of vertical transfer sections;

d) the return path from the uppest loop to the lowest loop is displaced by introducing a matching section in the arc symmetry points of lowest loop and uppest loop in order to not interfere with the storage ring structure;

e) major accelerator systems, as injection, RF-accelleration, electron beam manipulating devices and large size diagnostics are only required once, as compared to a planar arrangement of three storage rings;

f) the average current limiting ion trapping effects are strongly alleviated since for the same duty cycle as for a single facility the gap in the ring filling, which is defining the ion clearing efficiency, is three times larger, or g) alternatively for the same gap as for a single loop facility the number of bunches and consequently the average electron beam intensity can be increased; in consequence, i.e. for three storage rings, the overall central cone radiation power is not only tripled by three undulators but increased by a factor of 5;

h) for the top-up injection from the booster ring into the storage ring two anti-symmetrically arranged Lambertson septa are used.

A compact multi-bend magnet structure is used for the storage ring to generate a small emittance leading to high brilliance and a large coherent content of the light.

A booster is located on a level below the spiral storage ring and receives the electron beam from a linear accelerator placed in the central area of the booster.

The booster is continuously feeding the storage ring by top-up injection and keeping in this way the intensity of the electron beam stable down to a level of $10^{-3}$. Top-up injection is not only mandatory to reach the required intensity stability but also to combat lifetime reductions due to Touschek scattering and elastic beam gas scattering. Both, the low energy of the electron beam and the small vertical aperture gap of the undulator strongly enhance these effects.

These measures result in a sufficiently compact source that fits into conventional laboratories or their maintenance areas and is designed to have a footprint being about 50 $m^2$.

In addition to space saving, there are numerous other advantages as compared to an installation of 3 separated compact sources. Major systems are only required once, as injection, RF-acceleration, beam manipulating devices and sophisticated diagnostics.

For a single compact source the major beam and source parameters are collected in table 1. One crucial performance limiting parameter is the beam current. Higher single bunch currents are exposed to instabilities and consequently there exists an upper limit for the storable bunch current. The average current, which is defining the central cone power, is then limited by the number of bunches which can be accumulated in the storage ring since for the clearing of trapped ions a gap has to be introduced in the bunch train. It has been demonstrated in [3] that essentially the length of this gap defines the clearing efficiency. For a compact source with small circumference this gap can extend over half of the circumference.

In this respect the spiral compact source has a clear advantage. For the same gap length the average current is increased and consequently the central cone power enhanced. For the same clearing efficiency as for a single source, assuming a gap length of half of the circumference, 250 mA average current can be stored instead of 150 mA. In consequence, the gain in overall light beam power for a 3-spiral compact source is not only a factor 3 but even a factor of 5. Other embodiments having just 2 or even 4 or more loops of storage rings are also possible providing a respective beam power due to the number of undulators corresponding the number of loops in the spiral structure.

TABLE 1

Beam- and source parameters of a basic compact source that fulfills the requirements for actinic mask inspection

| | | |
|---|---|---|
| Beam parameters: | | |
| Beam energy | MeV | 430 |
| Beam current | mA | 150 |
| Horizontal emittance+) | nm | 9.2 |
| Source parameters: | | |
| U-length | m | 3.2 |
| Period length | mm | 16.0 |

TABLE 1-continued

| Beam- and source parameters of a basic compact source that fulfills the requirements for actinic mask inspection | | |
|---|---|---|
| Peak field | T | 0.42 |
| Deflection parameter | K | 0.624 |
| | Light characteristics: | |
| Resonance wavelength | nm | 13.5 |
| Central cone power | mW | 103.1 |
| Flux | ph/s/0.1% BW | $1.28 \times 10^{15}$ |
| Brilliance | ph/s/mm$^2$/mrad$^2$/0.1% BW | $2.64 \times 10^{18}$ |
| Coherent fraction | % | 9.4 |

+)Intra-Beam-Scattering blow up include

BRIEF DESCRIPTION OF THE SEVERAL VIEWS OF THE DRAWING

Preferred embodiments of the present invention are hereinafter described with reference to the attached drawings which depict in.

DESCRIPTION OF THE INVENTION

Figure 1:
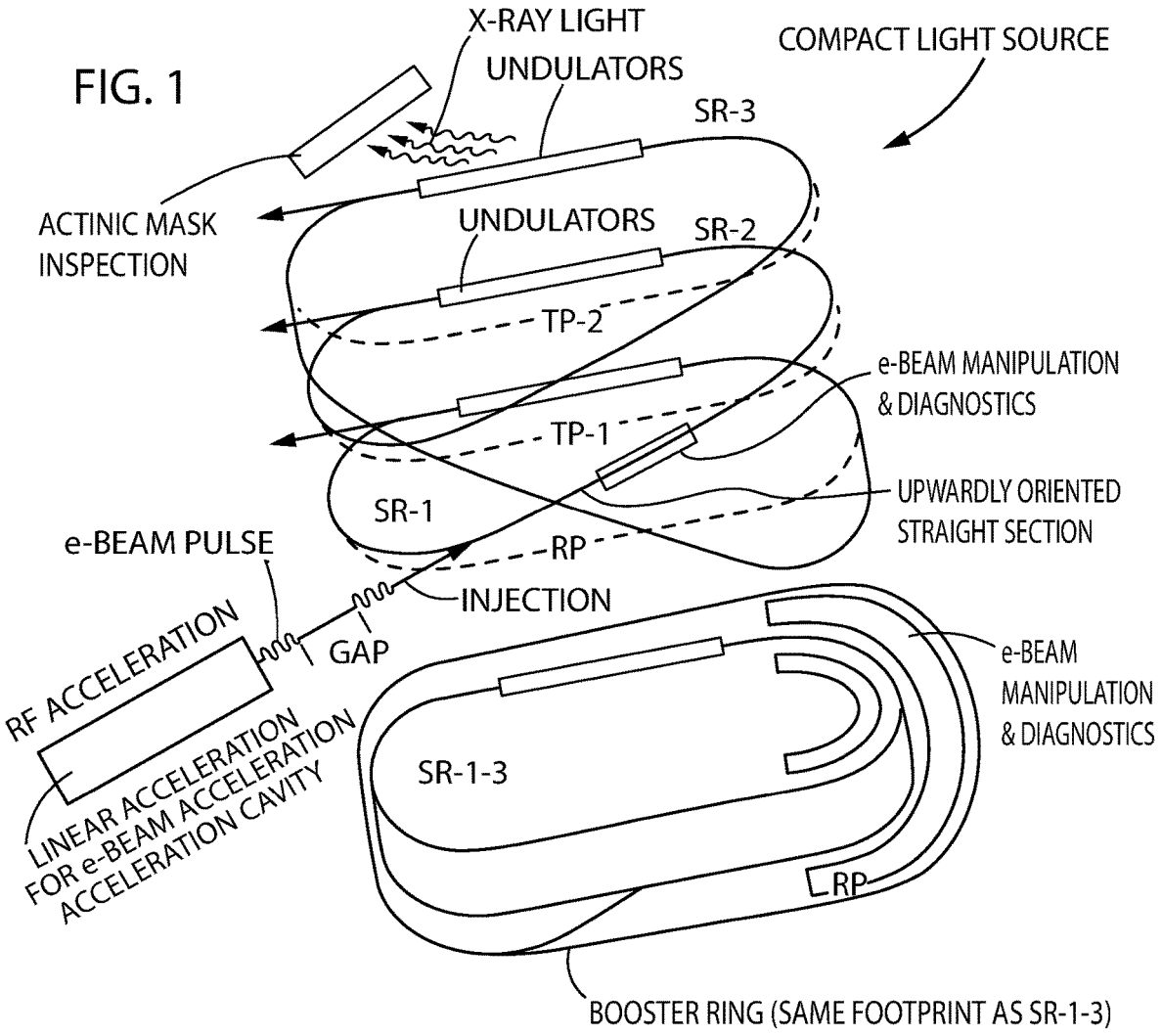
FIG. 1 perspective view and top view of the spiral storage ring.
Figure 2:
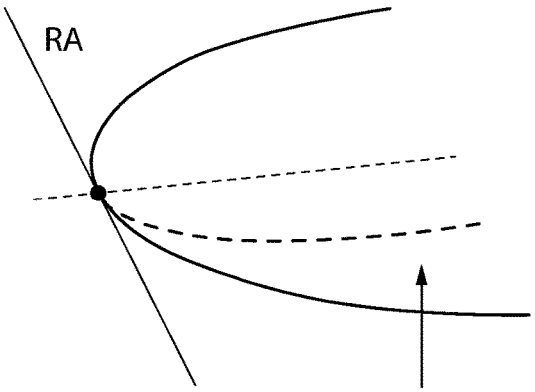
FIG. 2 rotation of the quarter to connect to the next storage ring level.
Figure 3:
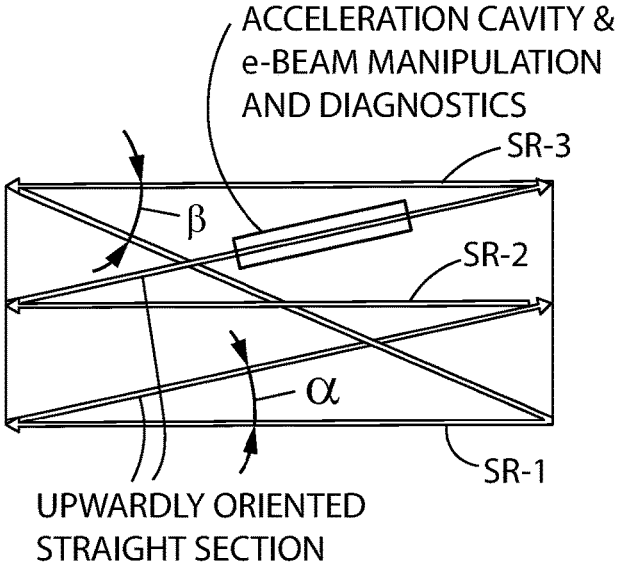
FIG. 3 schematic view of the quarter arc rotations.

The basic elements of the spiral source are three identical storage rings positioned on top of each other, which are connected in a spiral form as shown in FIG. 1 and constituting in this way one unit. Each of the loops contains one undulator which, if not used for actinic mask inspection, could be optimized for a different wavelength range (wavelength could be at EUV but may also be higher or lower according to the design of the periodicity and the distance of the magnet poles in the undulator. The three half rings in the back of FIG. 1 are hosting the three undulators. There is no special vertical deflection required to transport the beam from one level to the other. The quarter arcs (in front of FIG. 1) are simply bent in order to connect with the adjacent ring. The left quarter arc in front of SR-1 is bent upwards in the way as shown in FIG. 2, whereas the right quarter arc of SR-2 is bent downwards. The same configuration is implemented between SR-2 and SR-3. For the return arc from SR-3 to SR.1 the quarter arc is displaced by 0.5 to 1 m in order to not interfere with the front structure of the rings. The conceptual view of the transfer paths is shown in FIG. 3. The inclination of the transfer path angles are $\alpha$=7.4° between two loops and $\beta$=14.8° for the return path.

Figure 4:
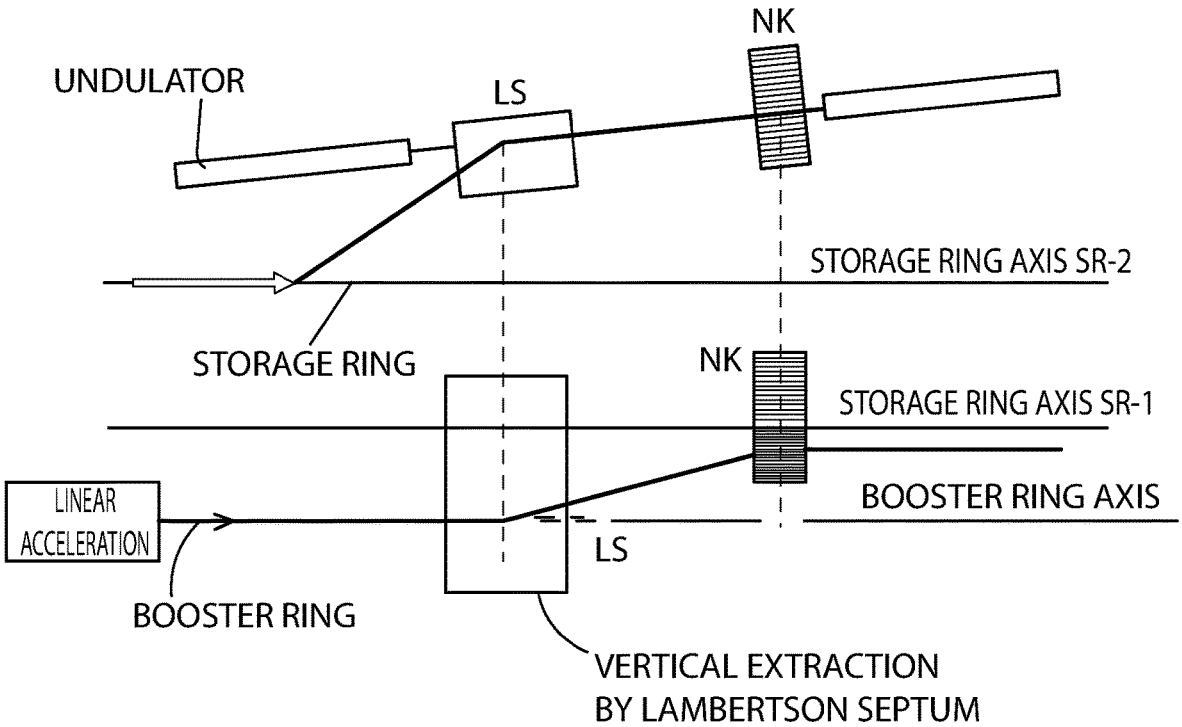
FIG. 4 conceptual view of the storage ring injection layout.

The design of the booster synchroton follows the racetrack shape of the spiral storage ring and is positioned below the lowest loop of the spiral storage ring. The injection in the storage ring is performed vertically on the slope between SR-1 and SR-2. The beam coming from the booster enters a Lambertson septum (LS) with horizontal displacement and angle and points after the vertical deflection of the LS to the downstream located pulsed nonlinear multipole kicker (NK) where it gets captured in the acceptance of the storage ring. FIG. 4 shows conceptually the vertical and horizontal beam transfer.

For top-up injection from the booster ring into the storage ring two antisymmetrically arranged Lambertson septa are used. For the injection into the storage ring, a pulsed multipole system is used which leaves the stored beam unaffected during the injection process.

The linear accelerator fits fully within the structure of the storage ring. This measure also contributes to the demand of reducing the footprint of the source.

Accelerating RF-cavities, beam manipulating devices and large scale diagnostics will be positioned in the second straight section connecting SR-2 with SR-3.

Further preferred embodiments of the present invention are listed in the depending claims.

REFERENCES

[1] A. Wrulich et al, Feasibility Study for COSAMI—a Compact EUV Source for Actinic Mask Inspection

[2] A. Streun: "COSAMI lattices: ring, booster and transfer line", Internal note, PSI Jun. 28, 2016.
with coherent diffraction imaging methods

[3] A. Wrulich, Ion trapping . . . .

The invention claimed is:

1. A spiral compact light source based on accelerator technology with multiple straight sections for implementing insertion devices, the compact light source comprising:

a) a foot print requiring a floor space not larger than for a compact source with only one undulator;

b) a plurality of storage rings combined in a spiral loop shape and including an uppermost loop and a lowermost loop;

c) said spiral loops being connected by rotation of quarter arcs without vertical transfer sections;

d) a return path from said uppermost loop to said lowermost loop being displaced by introducing a matching section in arc symmetry points of said lowermost loop and said uppermost loop not interfering with a structure of said storage rings;

e) accelerator systems including injection, RF-acceleration, electron beam manipulating devices and diagnostics being only required once, as compared to a planar configuration of a plurality of storage rings;

f) a ring filling having a gap defining an ion clearing efficiency being three times larger than for a duty cycle being equivalent to a single facility for alleviating average current limiting ion trapping effects, or g) an increased number of bunches and average electron beam intensity for a gap identical to a single loop facility, causing an overall central cone radiation power to be increased; and h) two anti-symmetrically disposed Lambertson septa for a top-up injection from a booster ring into said storage rings.

2. The compact spiral light source according to claim 1, wherein the light source provides light having characteristics for actinic mask inspection.

3. The compact spiral light source according to claim 2, wherein the light source provides light having a wavelength of 13.5 nm.

4. The compact spiral light source according to claim 1, wherein said plurality of storage rings include three storage rings and said overall central cone radiation power is increased by a factor of 5 rather than tripled by three undulators for said three storage rings.

5. The compact spiral light source according to claim 1, wherein said booster ring is positioned below said lowermost loop of said spiral configuration of storage rings from where the beam is extracted vertically by a Lambertson septum.

6. The compact spiral light source according to claim 1, wherein an injection system of said storage ring is placed in an upwardly oriented straight section interconnecting said lowermost loop and a next adjacent loop.

7. The compact spiral light source according to claim 1, wherein an accelerating cavity, said beam manipulating devices and said diagnostics are placed in an upwardly oriented straight section interconnecting said uppermost loop and an adjacent loop.

8. The spiral compact light source according to claim 1, wherein:

said footprint is approximately 50 $m^2$ in total;

said plurality of storage rings includes three storage rings; and said footprint has a racetrack shape with two long straight sections achieved by a spiral configuration of said three storage rings, a positioning of said booster ring below said lowermost loop of said spiral storage ring configuration and a positioning of a linear accelerator inside said booster ring.

* * * * *